United States Patent [19]

Mackal

[11] Patent Number: 4,627,823

[45] Date of Patent: Dec. 9, 1986

[54] SAFETY LATCHED AUTOMATIC ACTUATOR AND THROWABLE PERSONAL FLOTATION ASSEMBLY

[76] Inventor: Glenn Mackal, 4923 - 59th Ave., South, St. Petersburg, Fla. 33707

[21] Appl. No.: 633,607

[22] Filed: Jul. 23, 1984

[51] Int. Cl.[4] ..... B63H 16/06

[52] U.S. Cl. ..... 441/95

[58] Field of Search ..... 441/8-10, 441/80.81, 92-101; 244/149; 222/5, 54; 411/529

[56] References Cited

U.S. PATENT DOCUMENTS

| | | | |
|---|---|---|---|
| 2,353,933 | 7/1944 | Schneider | 411/529 |
| 2,894,658 | 7/1959 | Spidy | 441/95 |
| 3,526,339 | 9/1970 | Bernhardt et al. | 441/95 |
| 3,693,202 | 9/1972 | Ohtani | 441/97 |
| 3,828,381 | 8/1974 | Prager | 441/93 |
| 3,997,079 | 12/1976 | Niemann | 222/5 |
| 4,063,323 | 12/1977 | Salvarezza | 441/80 |

*Primary Examiner*—Galen L. Barefoot
*Assistant Examiner*—Jesûs D. Sotelo
*Attorney, Agent, or Firm*—Stein, Reese & Prescott

[57] ABSTRACT

A safety latched, water-activated, automatic inflator is disclosed for use in conjunction with inflatable devices such as personal flotation devices. The safety latch operates to relieve the pressure normally exerted by the actuator pin on the water soluble element during periods of nonuse such that the water soluble element will not prematurely degrade causing inadvertent and unintended actuation of the inflator. The safety latch of the invention comprises many embodiments including a removable latch lever, a pivotable latch lever, a rotary latch lever, a transverse rotary latch lever, and a push-/pull latch lever. A throwable personal floatation device is disclosed which incorporates the safety latch automatic inflator of the invention.

18 Claims, 27 Drawing Figures

SAFETY LATCHED AUTOMATIC ACTUATOR AND THROWABLE PERSONAL FLOTATION ASSEMBLY

BACKGROUND OF THE INVENTION

1. Field of the Invention

This invention relates to automatic actuators commonly used in conjunction with inflators for inflating inflatable articles such as personal flotation devices, rafts, buoys and emergency signaling equipment. More particularly, this invention relates to a safety latch incorporated in the automatic actuator of the inflator to prevent premature actuation of the inflator by the automatic actuator.

This invention also relates to inflatable articles such as personal flotation devices, rafts, buoys and emergency signaling equipment. More particularly, this invention relates to inflatable articles capable of being immediately deployed during an emergency situation to provide assistance to a person, such as a downed aviator, injured person, or a man overboard of a ship or a boat.

2. Description of the Prior Art

Presently there exist many types of inflators designed to inflate inflatable articles such as personal flotation devices (life vests, rings and horseshoes), life rafts, and emergency signaling equipment. These inflators typically comprise a body for receiving the neck of a cartridge of compressed gas such as carbon dioxide. A reciprocating piercing pin is disposed within the body for piercing the frangible seal of the cartridge to permit the compressed gas therein to flow into a manifold in the body and then into the device to be inflated. Typically, a manually movable firing lever is operatively connected to the piercing pin such that the piercing pin pierces the frangible seal of the cartridge upon manual movement of the same. U.S. Pat. No. 3,809,288, the disclosure of which is hereby incorporated by reference herein, illustrates one particular embodiment of a manual inflator.

While these manual inflators work suitably well, it was quickly learned that in an emergency situation, the person needing the assistance of the inflatable device, such as a downed aviator, injured person, or a man overboard, would fail or be unable to manually actuate the inflator. Accordingly, it was realized that a means should be provided for automatically actuating the inflator in such an emergency situation.

In response to this need, water activated automatic inflators have been developed which, when exposed to a fluid such as water, automatically actuate the piercing pin of the inflator causing inflation of the inflatable device. Typical water activated automatic inflators comprise a water activated trigger assembly including a water destructible or dissolvable element which retains a spring-loaded actuator pin in a cocked position in alignment with the piercing pin. Upon exposure to water causing the element to destruct or dissolve, the spring-loaded actuator pin is released to forcibly move from the cocked position to an actuated position to strike the piercing pin, either directly or indirectly by means of an intermediate transfer pin. Upon striking the piercing pin, the pin fractures the seal of the cartridge thereby allowing the gas contained therein to flow into the inflatable device to inflate the same. U.S. Pat. Nos. 3,997,079, 4,223,805, 4,267,944 and 4,260,075, the disclosures of each of which are hereby incorporated by reference herein, illustrate the examples of water activated automatic inflators.

While the above automatic inflators work quite well to automatically inflate the inflatable device in the event of an emergency situation, one major disadvantage to these automatic inflators is their tendency to self-actuate while stored for subsequent exigent use. Specifically, it is quite common for the automatic inflator to be stored in a highly humid environment such as on a ship or a boat. Over a period of time, the moisture contained within the humid air is absorbed by the water destructible or dissolvable element to such a degree that the element is weakened, particularly since the element is continually subjected to the force of the actuator spring. As the element gradually weakens, the strength of the element eventually becomes insufficient to retain the spring-loaded actuator pin in the cocked position. When the element collapses under the force of the compressed actuator pin, the actuator pin strikes the piercing pin causing premature and unintentional inflation of the inflatable device.

The problem of premature and unintentional actuation of the automatic inflator is so acute that it is not uncommon for a weakened water destructible or dissolvable element to be replaced with a new element on a periodic basis pursuant to a regularly scheduled maintenance plan. In this regard, it is noted that each of the prior art water activated automatic inflators disclosed in the above referenced patents teach a structure which may easily be disassembled to facilitate removal of a weakened element and the installation of a new one.

There also exist many types of rescue devices designed to assist in the rescue of persons. Basically, these types of rescue devices include personal flotation devices such as life vests, rings and horseshoes, life rafts, and emergency signaling equipment such as a float pole, an automatic strobe light, a whistle, and a dye marker. Illustrative examples of such rescue devices are disclosed in U.S. Pat. Nos. 2,264,321 and 3,754,291, the disclosures of each of which are hereby incorporated by reference herein.

A significant disadvantage to the above described resuce devices in their bulkiness and weight which precludes such devices from being rapidly deployed in the location where the endangered person is located. For example, it is often difficult, or impossible, to accurately throw a bulky life ring or horseshoe to a man overboard, particularly when the life ring must be thrown more than a few feet to the endangered person. Other rescue devices must be transported to the endangered person by a vehicle such as a plane (U.S. Pat. No. 2,264,321) or be deployed as quickly as possible from an undergoing sailboat before the sailboat has sailed too far from the person overboard (U.S. Pat. No. 3,754,291). Obviously, these rescue devices are limited in their ability to rescue an endangered person.

Because of the inability to quickly and accurately deploy a rescue device to an endangered person, it is common for persons, such as nonswimmers, to continually wear a life vest while on board a boat. In this manner, should the person fall overboard, such person will remain afloat until he is rescued. The need for wearing such a life vest is so great in many situations that lighter weight, more comfortable life vests have been developed which can be more comfortably worn by the person. Additionally, there has been recently developed a compact, inflatable personal flotation device which is stored within a case adapted to be fastened to a person's waist by means of a belt or the like. During use when the person has fallen overboard, the person manually pulls on a tab which forces the front panel of the case open while manually actuating an inflator to inflate the personal flotation device. While the device has received great commercial appeal, it still suffers from the aforementioned disadvantages; namely, the requirements that it be worn by the person at all times and that the person be capable of manually actuating the inflator when fallen overboard or otherwise placed in an emergency situation. A more complete disclosure of this device is set forth in the patent application entitled "Personal Flotation Device", Ser. No. 514,442, filed July 18, 1983, the disclosure of which is hereby incorporated by reference herein.

Therefore, it is an object of this invention to provide an apparatus which overcomes the aforementioned inadequacies of the prior art devices and provides an improvement which is a significant contribution to the advancement of the automatic inflator and personal flotation arts.

Another object of this invention is to provide a water activated activator for use in conjunction with an inflator designed to inflate an inflatable device such as a personal flotation device, life raft, buoy or emergency signaling device.

Another object of this invention is to provide a water activated automatic inflator which is less susceptible to premature and unintentional actuation.

Another object of this invention is to provide a water activated automatic inflator including a spring-loaded actuator pin which is retained in a cocked position by means of a water destructible or dissolvable element such that, upon exposure of the element to water, the actuator pin is released from its cocked position and forcibly moved to an actuated position to actuate the inflator and cause inflation of the inflatable device.

Another object of this invention is to provide a safety means for relieving the pressure exerted on the element by the spring-loaded actuator pin during storage of the device to be inflated.

Another object of this invention is to provide a water activated automatic inflator in which the safety latch means functions to retain the actuator pin in a safety position thereby relieving pressure exerted by the spring-loaded actuator pin on the water destructible or dissolvable element.

Another object of this invention is to provide a water activated automatic inflator in which the safety latch means operatively engages, directly or indirectly, the actuator pin to absorb the force of the spring-loaded actuator pin, thereby relieving the water destructible or dissolvable element from such force.

Another object of this invention is to provide a water activated automatic inflator including a safety latch means which is pivotably or rotatably connected in relation to the actuator pin and is movable from a non-armed position eliminating the pressure of the spring-loaded actuator pin on the element to an armed position in which the force of the spring-loaded actuator pin is exerted on the element in the normal automatic mode.

Another object of the invention is to provide a water activated automatic inflator including a safety latch means which is moved from a non-armed position to an armed position when the inflatable device is removed from storage such as from a storage bracket.

Another object of this invention is to provide a resuce device which can be quickly deployed to an endangered person.

Another object of this invention is to provide a rescue device adapted to be conveniently stored for subsequent, exigent use.

Another object of this invention is to provide a rescue device comprising a personal flotation device capable of keeping a person afloat in a body of water.

Another object of this invention is to provide a rescue device which is sufficiently lightweight to permit the resuce device to be thrown to the endangered person.

Another object of this invention is to provide a rescue device including an integral handle which facilitates the accurate throwing of the device to the endangered person.

Another object of this invention is to provide a rescue device containing an automatic inflator which automatically inflates the personal flotation device upon contact with water.

Another object of this invention is to provide a rescue device which may be stored in a marine environment for a considerable period of time without premature or unintentional firing of the automatic inflator of the personal flotation device.

Another object of this invention is to provide a rescue device including emergency signaling equipment.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a safety latched automatic actuator for use in conjunction with inflators designed to inflate inflatable devices such as personal flotation devices (life jackets, rings, and horseshoes), life rafts, buoys and emergency signaling equipment. More particularly, the invention comprises a safety latched automatic actuator including a reciprocating actuator pin which is serially movable to and from a safety position, a cocked position and an actuated position.

In the cocked position, a water destructible or dissolvable element retains the spring-loaded actuator pin in an armed, firing condition. Upon exposure of the element to water or other dissolving fluid, the spring-loaded actuator pin is released (fired) and forcibly moved to an actuated position directly or indirectly striking a piercing pin which in turn pierces a frangible seal of a cartridge containing compressed carbon dioxide, thereby allowing the carbon dioxide to flow into the device to be inflated.

In the safety position, the pressure normally exerted on the water destructible or dissolvable element by the spring-loaded actuator pin is greatly reduced or relieved completely by means of a safety latch. In this manner, the tendency of the water destructible or dissolvable element to prematurely or unintentionally disintegrate under the force of the spring-loaded actuator pin is greatly reduced thereby substantially eliminating the undesirable premature or unintentional inflation of the inflatable device. Upon movement of the safety latch to an armed position, the actuator pin is permitted to move to its cocked position, ready for firing.

The safety latch of the invention comprises a pivotable or rotatable device affixed to the automatic actuator and designed to be moved to and from its armed position and its non-armed position by pivotal or rotational movement of the same. Alternatively, the safety latch of the invention may comprise a removable device in which the automatic inflator is armed upon removal of the safety latch. In this regard, the removable safety latch may be tethered to the automatic actuator or the inflator itself. Further alternatively, the safety latch may be tethered to or made integral with an external fixed support such as a storage bracket, as more particularly described below.

The invention also comprises a throwable automatic personal flotation device particularly designed to be conveniently stored within a bracket for a considerable period of time and, when an emergency arises, quickly removed from the bracket and thrown to the endangered person in the water. Immediately upon striking the water, an automatic inflator automatically inflates a personal flotation device for use by the person to be rescued.

The inflatable personal flotation device may comprise a life vest, life ring, or a horseshoe designed to be worn or grasped by the endangered person upon inflation of the same. The deflated personal flotation device, together with the automatic inflator are compactly stored within a canister. The canister comprises two half-sections which mate together by means of a frangible seal. The personal flotation device is automatically inflated by a water-activated automatic inflator, such as those described above.

A bracket is provided for affixing to a fixed support such as the bulkhead or transom of a boat. The bracket is designed to removably store the canister in an upright condition to prevent precipitation, such as rain, from entering the opened end of the canister and triggering the trigger assembly of the automatic inflator.

The automatic inflator utilized by this invention may include the safety latched automatic actuator as more particularly set forth above. In this regard, the safety latched lever of the automatic actuator is of the removable type, and is made an integral part of the canister bracket. This assures that the safety latch lever is in its non-armed position while the canister is mounted within the bracket. Conversely, as the canister is removed from the bracket to be thrown to the endangered person, the safety latch lever (integral with the bracket is disengaged from the automatic actuator, thereby arming the actuator for later firing upon being exposed to water.

It should be apparent that the throwable automatic personal flotation device of the invention overcomes many of the disadvantages of the known devices discussed above. Specifically, the bracket containing the canister can be permanently mounted to virtually any type of accessible location. During an emergency situation, the canister may be quickly grasped at the handle portion thereof and thrown to the endangered person, such as a person fallen overboard. The personal flotation device immediately begins inflating upon contact with the water while forcing the two half-sections of the canister apart thereby completely releasing the personal flotation device. The endangered person then may quickly grasp the personal flotation device and fasten himself into it to be later rescued.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
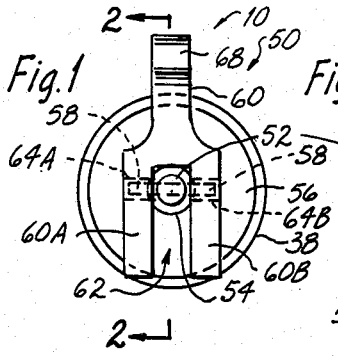
FIG. 1 is an end view of the first embodiment of the safety latched automatic actuator of the invention.

FIGS. 1–22 illustrate the safety latched automatic actuator 10 of the invention for use in conjunction with conventional inflators 12. By way of background, conventional inflators 12 basically comprise an internally threaded insert 14 molded within a body 16. The insert 14 is designed to threadably receive a cartridge 18 containing compressed gas such as carbon dioxide. A piercing pin 20 is reciprocatingly positioned within the body 16 in alignment with a frangible seal 22 of the cartridge 18. The passageway 24 containing the reciprocating piercing pin 20 is connected in fluid communication with a manifold 26 which is, in turn, connected in fluid communication with the inflatable device (not shown) to be inflated. A manual lever 28 is pivotably connected in alignment with the piercing pin 20 in such a manner that movement of the handle 30 of the lever 28 causes the cammed end 32 of the lever 28 to engage the piercing pin 20 and force the piercing pin 20 toward the cartridge 18. Further movement of the handle 30 eventually causes the piercing pin 20 to fracture the seal 22 of the cartridge 18 thereby releasing the compressed gas contained therein and permitting the same to flow into the inflatable article via passageway 24 and manifold 26. A lanyard 34 may be connected to the handle 30 to facilitate operation of the lever 28. Further, the lever 28 may be removable to prevent unnecessary force being imparted to the inflator 12 while the lanyard 34 is being jerked.

The safety latched automatic actuator 10 of the invention basically comprises an actuator pin 36 which is reciprocally mounted within housing 38. The actuator pin 36 is spring-loaded by means of compression spring 40 which urges the actuator pin 36 into engagement with a water-activated trigger assembly, generally indicated by numeral 42. Basically, trigger assembly 42 comprises a water destructible or dissolvable element 44 which functions to directly or indirectly retain the spring-loaded actuator pin 36 in position bearing against the trigger assembly 42, hereinafter referred to as the "cocked" position. The element 44 is manufactured from a substance which disintegrates or dissolves upon being exposed to a fluid such as water.

The safety latched automatic actuator 10 of the invention is connected to the inflator 12 by means of an intermediate forked transfer pin 46 reciprocally positioned in axial alignment with the piercing pin 20 of the inflator 12 and the actuator pin 36 of the actuator 10.

Figure 2:
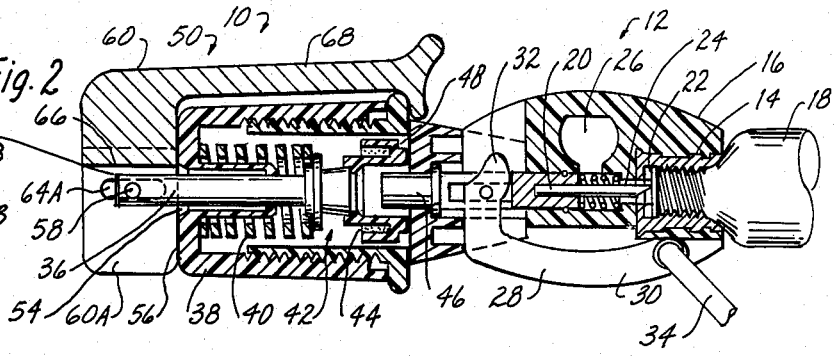
FIG. 2 is a longitudinal, partial cross-sectional view of FIG. 1, illustrating the actuator of the invention connected to a conventional inflator and the safety latch of the invention positioned in its armed condition with the actuator pin positioned in its cocked position.
Figure 4:
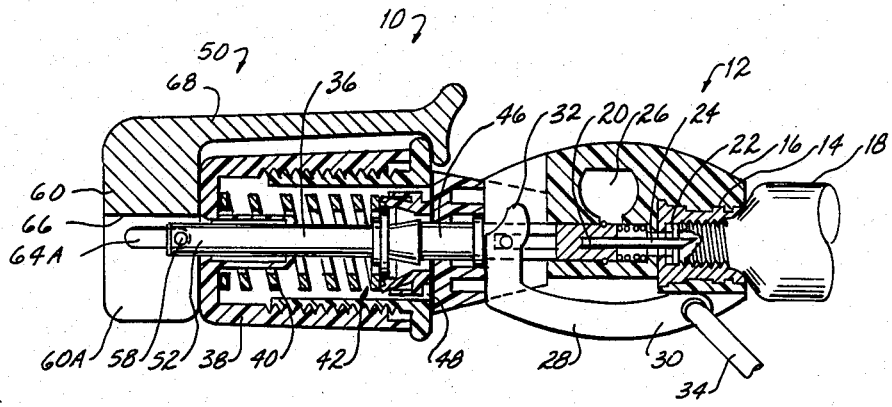
FIG. 4 is still another longitudinal, partial cross-sectional view of FIG. 1, illustrating the safety latch of the invention positioned in its armed position with the actuator pin being in its actuated position after triggering of the trigger assembly.

During use in the automatic mode, water entered through apertures 48 in the bottom of the automatic actuator 10 flows to the trigger assembly 42 and is absorbed by the water destructible or dissolvable element 44. Upon disintegration of element 44, the actuator pin 36 is permitted to move forwardly from its cocked position, where it was formerly retained by the trigger assembly 42 as shown in FIG. 2, to an actuated position, as shown in FIG. 4, in which the actuator pin 36 strikes the intermediate transfer pin 46 which, in turn, strikes the piercing pin 20 causing fracturing of the seal 22 of the cartridge 18 and subsequent inflation of the inflatable device.

More particularly, the invention 10 comprises a safety latch means 50 which is movable to and from a non-armed position and an armed position. In the non-armed position, the safety latch means 50 operatively engages the spring-loaded actuator pin 36 to relieve the pressure normally exerted by the pin 36 on the trigger assembly 42. This position of the actuator pin 36 shall hereinafter be referred to as the "safety" position. In the safety position, the safety latch means 50 may axially move the actuator pin 36 an appreciable distance from the cocked position as shown in FIG. 3, or an infinitesimally small distance from the cocked position sufficient to relieve substantially all of the pressure normally exerted by the actuator pin 36 on the trigger assembly 42.

The first embodiment of the safety latch means 50 is illustrated in FIGS. 1–4. Specifically, the actuator pin 36 includes an increased length having a proximal end 52 which protrudes from an aperture 54 in the top portion 56 of the housing 38. A retaining pin 58 is positioned transversely through the proximal end 52 of the actuator pin 36. The safety latch means 50 further comprises a forked safety latch lever 60 including two legs 60A and 60B which define an opening 62 therebetween. The opening 62 is dimensioned and configured to slidably receive the proximal end 52 of the actuator pin 36. A pair of slots 64A and 64B are respectively disposed within the pair of legs 60A and 60B in a direction parallel to the base portion 66 of the slotted opening 62. The slots 64A and 64B are dimensioned to slidably and rotatably receive the end of the retaining pin 58 extending from opposing sides of the actuator pin 36. Finally, a handle 68 is connected or integrally formed with the forked safety latch lever 60 to facilitate pivotable movement of the safety latch lever 60 about the axis of the retaining pin 58.

Figure 3:
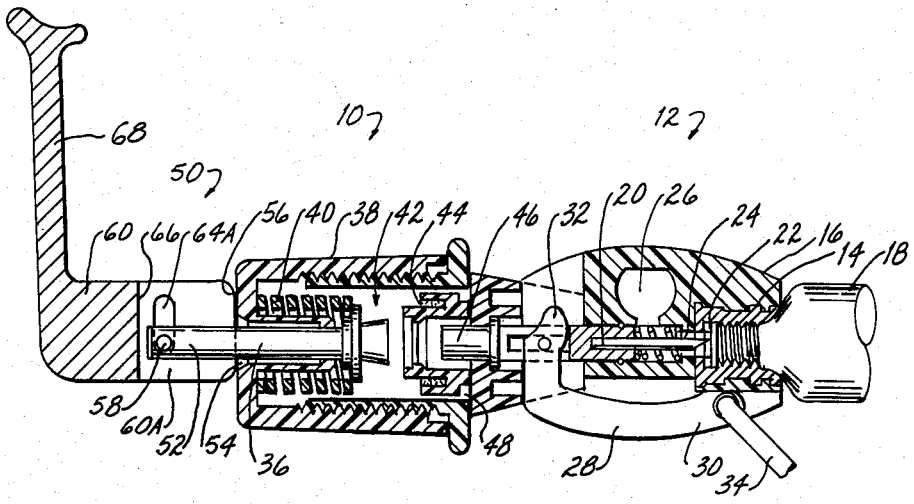
FIG. 3 is another longitudinal, partial cross-sectional view of FIG. 1, illustrating the safety latch of the invention positioned in its non-armed position with the actuator pin in its safety position.

FIG. 3 illustrates the safety latch lever 60 in a non-armed position with the longitudinal axes of slots 64A and 64B being positioned substantially perpendicular to the axis of the actuator pin 36. In this non-armed position, the actuator pin 36, by virtue of the retaining pin 58 bearing against the edges of the slots 64A and 64B, is forced appreciably away from its cocked position bearing against the trigger assembly 42 to a safety position.

The safety latch lever 60 is moved to an armed position by simply rotating the lever 60 about the axis of the retaining pin 58 until the longitudinal axis of the slots 64A and 64B are parallel to the axis of the actuator pin 36. In this armed position, it is apparent that the actuator pin 36 is permitted to return from its safety position (FIG. 3) to its cocked position (FIG. 2) whereupon it is retained by the trigger assembly 42. Of course, upon triggering by the trigger assembly 42, the actuator pin 36 is permitted to move to its actuated position by virtue of the fact that the retaining pin 58 is permitted to move longitudinally within the now-aligned slots 64A and 64B (FIG. 4).

It should be apparent that the safety latch lever 60 may be repeatedly pivoted to and from its armed and non-armed positions (FIGS. 2 and 3, respectively) without damage to the trigger assembly 42 or other components of the actuator pin 36 or inflator 12. Accordingly, during a possible emergency situation, the automatic actuator 10 of the invention may be armed to permit quick deployment of the inflatable device and, should the emergency situation resolve itself without the need for inflating the inflatable device, the automatic actuator 10 may be conveniently disarmed and returned to storage for possible later use.

The handle 68 of the first embodiment of the safety latch means 50 is illustrated as extending transversely with respect to the axis of the actuator pin 36 when the latch lever 60 is in a non-armed position (FIG. 3) and, when in an armed position (FIG. 2), positioned flush with the outside surface of the housing 38. This particular arrangement conveniently indicates to the person using the automatic actuator 10 that when the handle 68 is flush with the actuator 10, it is in an armed condition, ready for immediate use. Conversely, when the handle 68 is positioned transversely, the person quickly realizes that the actuator 10 is disarmed and must be armed prior to use. However, without departing from the spirit and scope of this invention, handle 68 may alternatively comprise any other configuration or extend at any angle from the retaining pin 58.

FIGS. 5–8 illustrate the second embodiment of the safety latch means 50. More particularly, the second embodiment is similar to the first, wherein the actuator pin 36 includes an increased length having a proximal end 52 which protrudes from an aperture 54 in the top portion 56 of the housing 38 and with a retaining pin 58 positioned transversely through the proximal end 52 of the actuator pin 36. However, contrary to the first embodiment, the safety latch means 50 comprises a rotary latch lever 70 having an axial hole 72 positioned through the center thereof for rotatably receiving the proximal end 52 of the actuator pin 36. A blind slot 74 is disposed within the rotary latch lever 70 in a position transverse to the axial hole 72. The blind slot 74 is dimensioned to receive the retaining pin 54 when aligned therewith.

Figure 5:
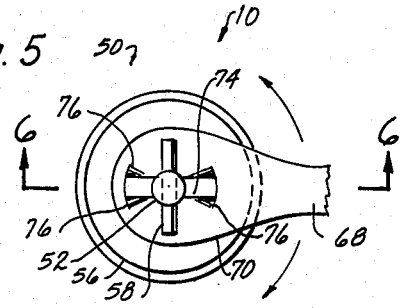
FIG. 5 is a partial end view of the second embodiment of the invention illustrating the safety latch in a non-armed position.
Figure 7:
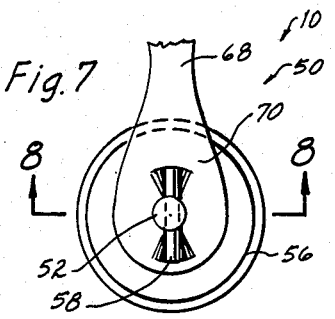
FIG. 7 is a partial end view of the second embodiment of the invention, illustrating the safety latch in an armed position.
Figure 6:
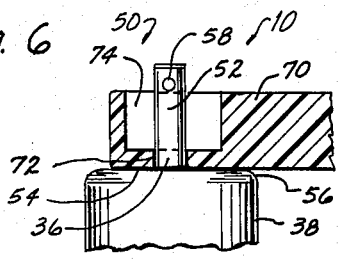
FIG. 6 is a partial side plan view of FIG. 5, partially in section along lines 6—6 of FIG. 5, showing the cross-sectional configuration of the safety latch lever.
Figure 8:
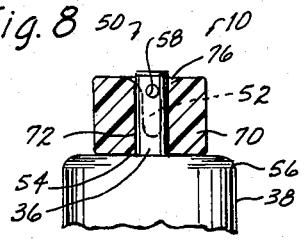
FIG. 8 is a partial side plan view of FIG. 7, partially in section along lines 8—8 of FIG. 7, showing the cross-sectional configuration of the safety latch lever.

During use, as shown in FIGS. 5 and 6, the rotary latch lever 70 is in its non-armed position when the blind slot 74 is positioned transversely with respect to the retaining pin 58 with the retaining pin 58 resting on the upper surface of the rotary latch lever 70. In this position, the actuator pin 36 is moved from its cocked position to its safety position as discussed previously. To arm the actuator 10, the rotary latch lever 70 is simply rotated ninety degrees until the blind slot 74 is aligned with the retaining pin 58 as shown in FIGS. 7 and 8, thereby permitting the actuator pin 36 to move appreciably forward to its cocked position. It is noted that the inner edges 76 of the blind slot 74 may be sloped to facilitate the movement of the actuator pin 36 to and from its cocked position and its safety position as the rotary latch lever 70 is rotated to and from its armed position and its nonarmed position, respectively.

Figure 9:
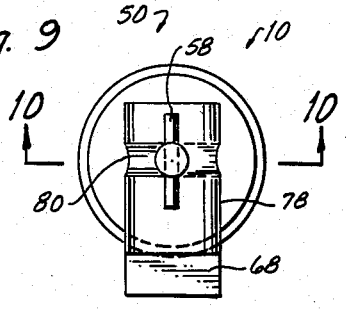
FIG. 9 is a partial end view of the third embodiment of the invention, illustrating the safety latch in a non-armed position.
Figure 11:
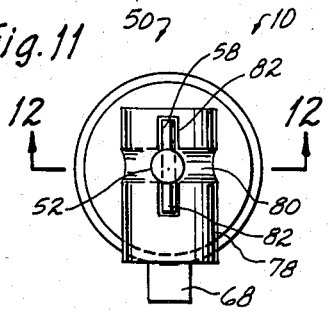
FIG. 11 is a partial end view of the third embodiment of the invention, illustrating the safety latch in an armed position.
Figure 10:
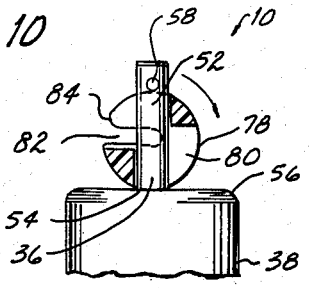
FIG. 10 is a partial side plan view of FIG. 9, partially in section along lines 10—10 of FIG. 9, showing the cross-sectional configuration of the safety latch lever.
Figure 12:
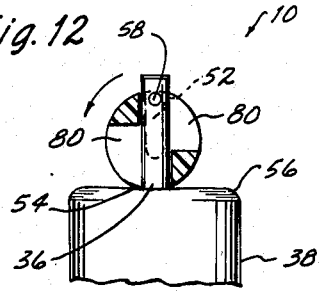
FIG. 12 is a partial side plan view of FIG. 11, partially in section along lines 12—12 of FIG. 11, showing the cross-sectional configuration of the safety latch lever.

The third embodiment of the safety latch means 50 is illustrated in FIGS. 9–12. The third embodiment of the safety latch means 50 is also similar to the first embodiment inasmuch as it comprises an actuator pin 36 having an increased length with the proximal end 52 thereof protruding from an aperture 54 in the top portion 56 of the housing 38 with a retaining pin 58 positioned transversely through the proximal end 52. However, the safety latch means 50 further comprises a transverse rotary latch lever 78 having a generally cylindrical configuration. A slot 80 is positioned transversely through the transverse rotary latch lever 78 to receive the actuator pin 36 and to permit ninety degree rotation of the latch lever 70 about an axis transverse to the actuator pin 36. A blind slot 82 is longitudinally positioned within the latch lever 78 and is dimensioned to receive the retaining pin 58 when aligned therewith. As illustrated in FIGS. 9 and 10, the transverse rotary latch lever 78 is in a non-armed position when rotated counter-clockwise such that the retaining pin 58 rests upon the outer surface of the cylindrical latch lever 78. Upon rotation of the transverse rotary latch lever 78 by ninety degrees clockwise, as shown in FIGS. 11 and 12, the retaining pin 58 is aligned with blind slot 82. In this armed position, upon triggering by the trigger assembly 42, the retaining pin 58 is permitted to move into the blind slot 82 and, hence, move from its cocked position to its actuated position. It is noted that the contacting surface 84 may be angularly disposed so as to facilitate movement of the actuator pin 36 to and from its cocked position and its safety position as the transverse rotary latch lever 78 is rotated to and from its armed position and non-armed position, respectively.

Figure 13:
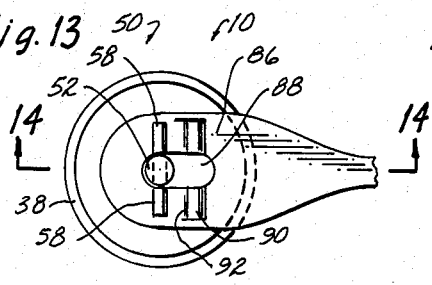
FIG. 13 is a partial end view of the fourth embodiment of the invention, illustrating the safety latch in a non-armed position.
Figure 15:
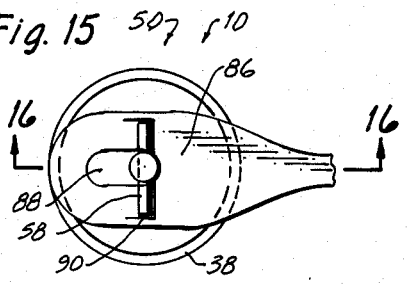
FIG. 15 is a partial end view of the fourth embodiment of the invention, illustrating the safety latch in an armed position.
Figure 14:
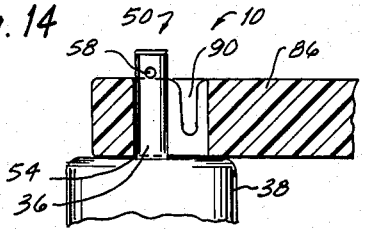
FIG. 14 is a partial side plan view of FIG. 13, partially in section along lines 14—14 of FIG. 13, showing the cross-sectional configuration of the safety latch lever.
Figure 16:
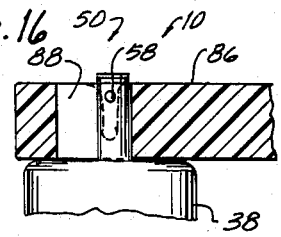
FIG. 16 is a partial side plan view of FIG. 15, partially in section along lines 16—16 of FIG. 15, showing the cross-sectional configuration of the safety latch lever.
Figure 17:
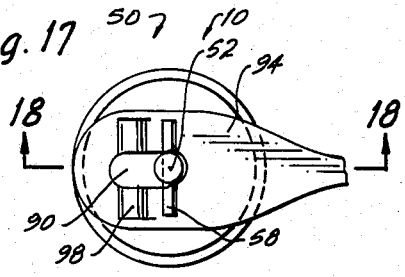
FIG. 17 is a partial end view of the fifth embodiment of the invention, illustrating the safety latch in a non-armed position.
Figure 19:
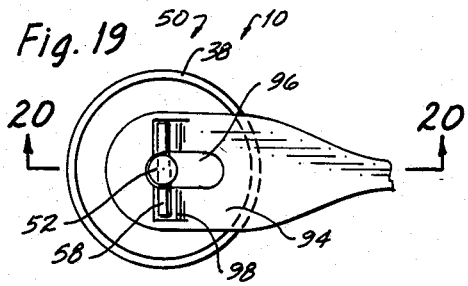
FIG. 19 is a partial end view of the fifth embodiment of the invention, illustrating the safety latch in an armed position.
Figure 18:
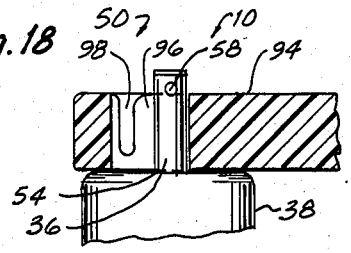
FIG. 18 is a partial side plan view of FIG. 17, partially in section along lines 18—18 of FIG. 17, showing the cross-sectional configuration of the safety latch lever.
Figure 20:
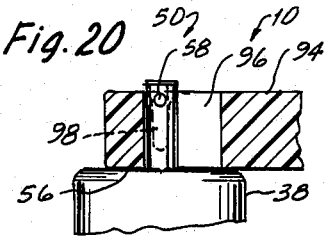
FIG. 20 is a partial side plan view of FIG. 19, partially in section along lines 20—20 of FIG. 19, showing the cross-sectional configuration of the safety latch lever.
Figure 25:
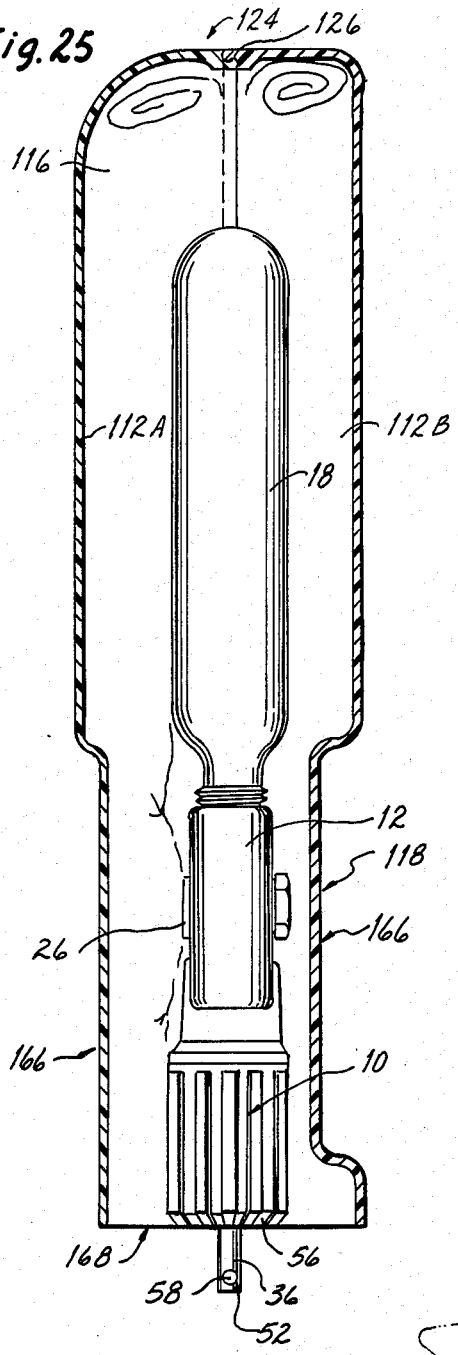
FIG. 25 is a longitudinal view of the canister of the invention, partially in section along lines 25—25 of FIG. 24, illustrating the inflatable personal flotation device and the safety latched automatic inflator positioned therein.

FIGS. 13–16 illustrate still a fourth embodiment of the safety latch means 50 wherein the actuator pin 36 includes an increased length having a proximal end 52 which protrude from an aperture 54 in the top portion 56 of the housing 38 and wherein a retaining pin 58 is positioned transversely through the proximal end 52 of the actuator pin 36. The safety latch means 50 further comprises a substantially flat push latch lever 86 having a slot 88 positioned therethrough for receiving the actuator pin 36. A blind slot 90 is positioned in the push latch lever 86 in a position transverse to slot 88. FIGS. 13 and 14 illustrate the push latch lever 86 in its non-armed position, in which the retaining pin 58 rests upon the upper surface of the push latch lever 86. The push latch lever 86 is moved to its armed position by simply pushing the push latch lever 86 causing actuator pin 36 to move within slot 88 until the retaining pin 58 is aligned with blind slot 90. When the push latch lever 86 is in its armed position, the actuator pin 36 is permitted to move from its safety position to its cocked position and, further, to its actuated position by virtue of the fact that the retaining pin 58 is permitted to move into blind slot 90. It is also noted that the push latch lever 86 may be conveniently moved from its armed position to its non-armed position by simply pulling on the same until the retaining pin 58 slides on top of the push latch lever 86. In this regard, the contacting surfaces 92 may be sloped to permit such action.

FIGS. 17–20 illustrate still a fifth embodiment of the safety latch means 50 which is similar to the fourth embodiment discussed previously. Specifically, this fifth embodiment comprises a pull latch lever 94 having a slot 96 and blind slot 98 positioned therein. This pull latch lever 94 operates basically on the same principle as the push latch lever 86 discussed above except for the fact that the pull latch lever 94 should be pushed instead of pulled in order to move it from its non-armed position to its armed position.

Figure 21:
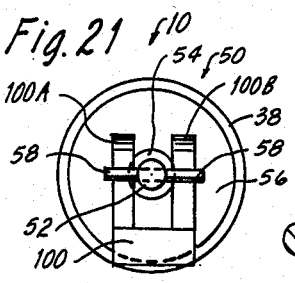
FIG. 21 is a partial end view of the sixth embodiment of the invention, illustrating the removable safety latch in a non-armed position.
Figure 22:
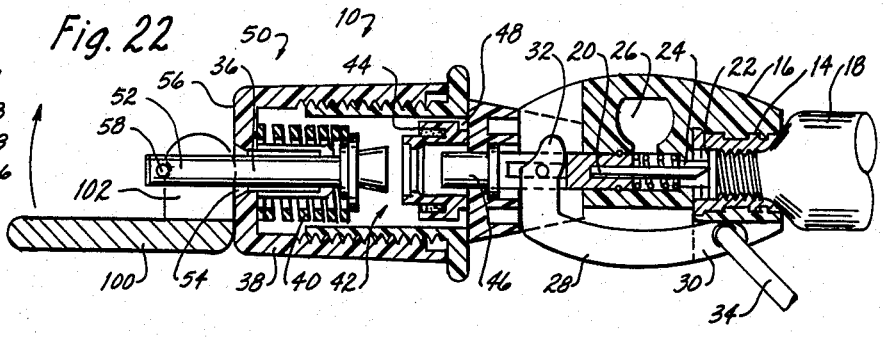
FIG. 22 is a partial side plan view of FIG. 21, partially in section, showing the cross-sectional configuration of the removable safety latch lever.

FIGS. 21 and 22 illustrate a sixth embodiment of the safety latch means 50 which similarly comprises an actuator pin 36 having an increased length with the proximal end 52 thereof extending through an aperture 54 in the top portion 56 of the housing 38 and a retaining pin 58 positioned transversely through the proximal end 52 of the actuator pin 36. However, in the sixth embodiment, the safety latch means 50 comprises a removable, forked lever 100 having a pair of legs 100A and 100B defining a slotted opening 102 therebetween. When in the nonarmed position, as shown in FIGS. 21 and 22, the opposing ends of the retaining pin 58 rest upon the legs 100A and 100B of the removable, forked lever 100 thereby securing the actuator pin 36 in its safety position. Upon pivotable movement of the removable, forked lever 100 in the direction illustrated, the retaining pin 58 slides off the rounded ends of the legs 100A and 100B of the removable, forked lever 100 until the removable, forked lever 100 is completely released therefrom. Once released, the actuator pin 36 is permitted to move from its safety position to its cocked position for firing by the trigger assembly 42. The loose, removable, forked lever 100 may be reinstalled to its non-armed position by simply positioning the ends of the legs 100A and 100B against the retaining pin 58 and then forcing the retaining pin 58 to its safety position by slipping the legs 100A and 100B of the removable, forked lever 100 between the retaining pin 58 and the top portion 56 of the housing 38.

It shall be understood that the removable, forked lever 100 may be tethered to the actuator 10 or the inflator 12 so that it will not be lost once removed. Alternatively, the removable, forked lever 100 may be tethered to or made an integral part of a fixed storage support, storing the actuator 10, the inflator 12, and the inflatable device, as more particularly set forth below.

It shall also be understood that any one of the above six embodiments of the safety latch means, or their equivalents, may be utilized in combination with inflators designed to inflate one or more inflatables by piercing one or more cartridges of compressed gas. For example, without departing from the spirit and scope of this invention, the safety latch means of the invention may be used in combination with the inflator disclosed in U.S. patent aplication entitled "Multiple Firing Inflator", Ser. No. 449,677, filed Dec. 14, 1982, the disclosure of which is hereby incorporated by reference herein.

Figure 26:
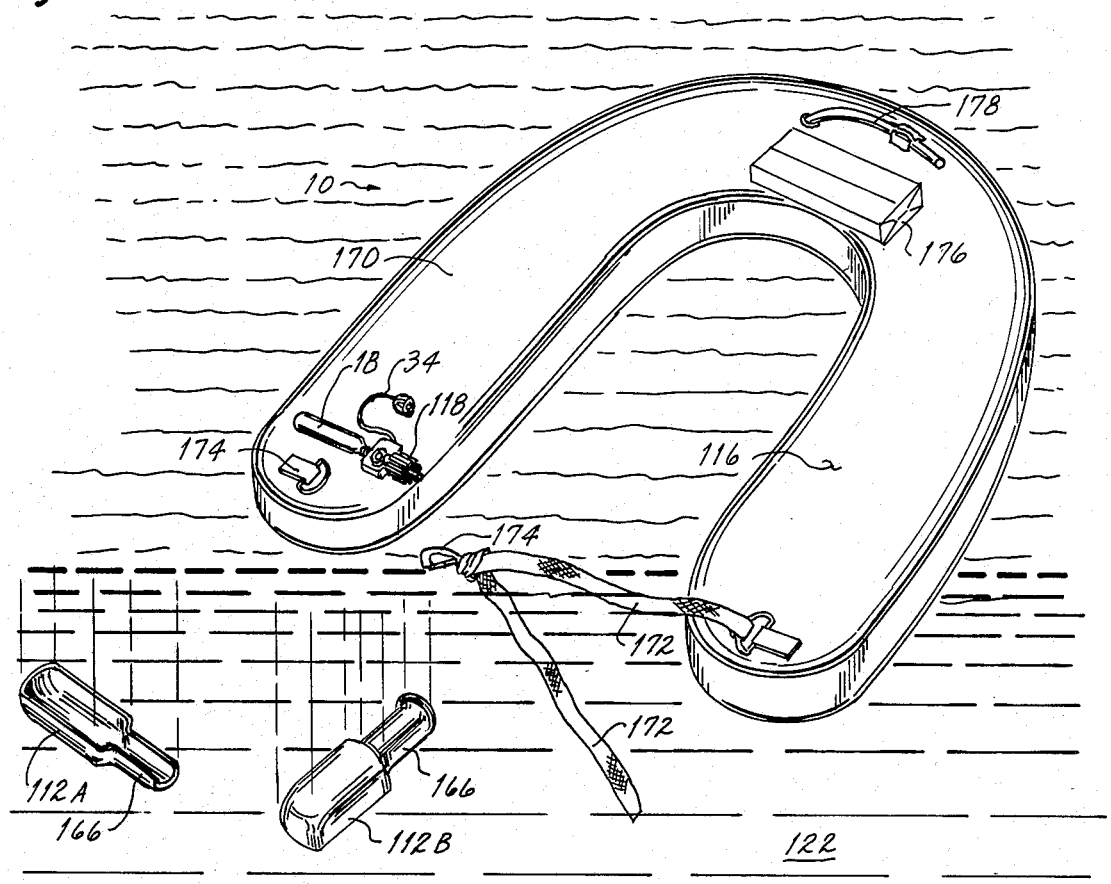
FIG. 26 illustrates the personal flotation device of the invention inflated in a body of water with the two half-sections of the canister having been forced apart upon inflation of the personal flotation device.

FIGS. 23–27 illustrate the first embodiment of the throwable automatic personal flotation device 110 of the invention. Device 110 comprises a canister 112 which is removably secured within a bracket 114. A personal flotation device 116 along with an automatic inflator 118 are stored within the canister 112. The automatic inflator 118 preferably includes one of the water activated automatic inflators disclosed above and more preferably the safety latched automatic inflator of this invention. As illustrated in FIG. 26, the device 110 of the invention is used during an emergency by removing the canister 112 from the bracket 114 and throwing the same to a person to be rescued from a body of water 122. Immediately upon the canister 112 coming into contact with the water 122, the automatic inflator 118 is inflated to inflate the personal flotation device 116.

More particularly, canister 112 comprises two half-sections 112A and 112B which, together, define a substantially cylindrical design. The two half-sections 112A and 112B are removably fastened together at seam 124. Preferably, seam 124 may comprise a tongue-in-groove arrangement 126 or the like. Alternatively, seam 124 may comprise a watertight overlapping arrangement 126A (see FIG. 27).

The bracket 114 comprises an elongated back member 144 for connection to a rigid support, such as the bulkhead or transom of a boat, by means of threaded fasteners or the like. The bracket 114 further comprises a top support 148 and a bottom support 150. Top support 148 extends generally perpendicular to back member 144 and includes an indentation 152 approximating the configuration of the top of the canister 112 in such a manner that the canister 112 is removably secured between top support 148 and bottom support 150.

Figure 23:
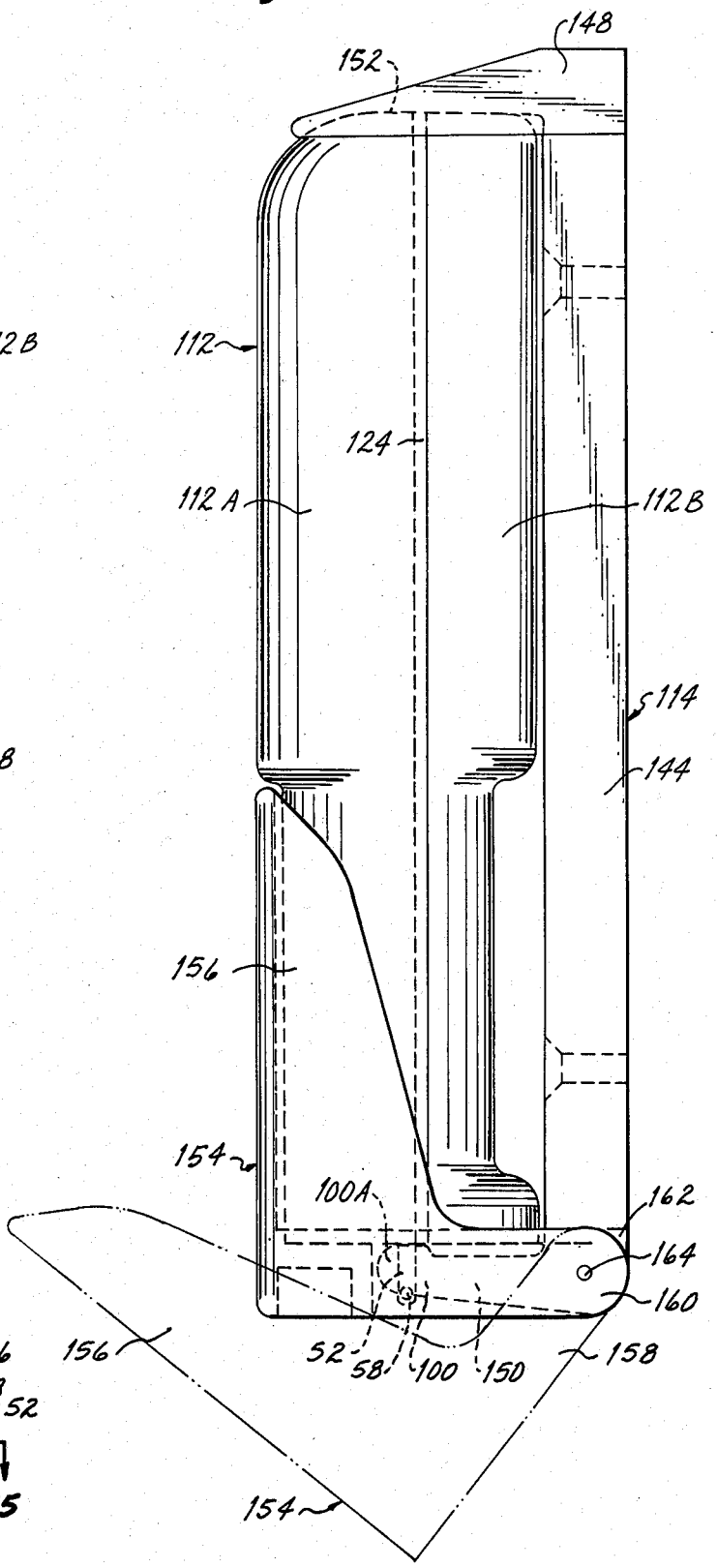
FIG. 23 is side view of the first embodiment of the throwable automatic personal flotation device of the invention showing, in phantom, the latching handle of the bracket in a partially opened position.
Figure 24:
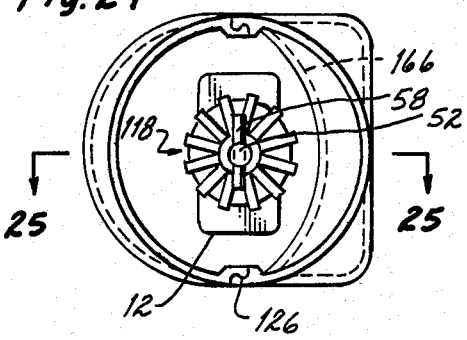
FIG. 24 is a bottom end view of the canister of the invention.

A latching handle 154 is provided to more securely retain the canister 112 into position between the top and bottom support 148 and 150 when the latching handle 154 is in its closed position, and to permit easy removal of the canister 112 from the bracket 114 when the latching handle 154 is pivoted to its opened position, as shown in phantom in FIG. 23. Latching handle 154 comprises an upstanding arcuate member 156 approximating the design of the lower portion of the canister 112. The latching handle 154 further comprises a pair of pivot members 158 extending generally perpendicular to the arcuate member 156. The ends 160 of the pivot member 158 are pivotably connected to the opposing side edges 162 of the bracket 114 at pivot points 164.

The canister 112 may comprise a reduced-diameter lower portion functioning as throw handle 166 and to function as a recess for the latching handle 154 such that the front surface of the canister 112 is substantially flush with the latching handle 154 when handle 154 is in its closed position.

From the foregoing description of the throwable automatic personal flotation device of the invention 110, it should be apparent that the device 110 overcomes many of the disadvantages associated with previously known rescue devices. Specifically, the canister 112 can be conveniently stored in an accessible location by means of bracket 114. When an emergency arises, latching handle 154 may be pivoted to its opened position, the canister 112 removed by grasping throw handle 166, and the canister 112 thrown to the person in the body of water 122.

As illustrated in FIG. 26, once in the water 122, the water 122 flows into the opened end 168 formed by the two half-sections 112A and 112B of the canister 112 and then into the automatic actuator of the inflator 118 to trigger the water-activated trigger assembly thereof. Upon triggering of the trigger assembly, the spring-loaded actuator pin is released to strike the piercing pin thereby causing inflation of the personal flotation device 116. The person then simply grasps the personal flotation device and fastens himself/herself therein.

As shown in FIG. 26, the personal flotation device 116 may comprise an inflatable horseshoe 170 having a retaining strap 172 and fastener 174 combination for securely retaining the person within horesehoe 170. The horseshoe 170 may further comprise a pouch 176 for storing articles and a manual inflator tube 178. Automatic signaling equipment such as a strobe light may also provided.

As noted earier, the throwable automatic personal flotation device 110 of this invention may incorporate the safety latched automatic actuator 10 described above. In this regard, the actuator pin 36 of the automatic actuator 10 includes a retaining pin 58 which is positioned through the proximal end 52 thereof which extends from the housing 38 of the automatic actuator 10. A removable latch lever, operatively similar to lever 100 illustrated in FIGS. 21 and 22, is provided to retain the actuator pin 36 in a safety position in which the pressure exerted by actuator pin 36 on the trigger assembly 42 is substantially or completely eliminated. As before, latch lever 100 comprises a forked configuration having a pair of legs 100A and 100B defining a slotted opening 102 therebetween. In a non-armed position, the latch lever 100 is positioned between the retaining pin 58 and the top surface of the housing 38 to force the actuator pin 36 away from the trigger assembly 42, thereby relieving pressure on the same. In its armed position, latch lever 100 is removed from engagement between retaining pin 58 and housing 38 to allow actuator pin 36 to move to a cocked position against trigger assembly 42. Upon exposure of the trigger assembly 42 to water as described above, actuator pin 36 strikes piercing pin 20 causing inflation of the personal flotation device 116.

The latch lever 100 may form an integral part of the bracket 14 such that the latch lever 100 is moved from engagement with the actuator pin 36 as the canister 112 is removed from bracket 114. In one embodiment, latch lever 110 forms an integral part with the bottom support 150 of the bracket 114, as illustrated in FIG. 23. In this manner, after the latching handle 154 is opened, the throw handle 166 of the canister 112 may be grasped and pulled until latch lever 100 disengages from the proximal end 184 of the actuator pin 36. The canister 112, now in a fully armed mode, may then be thrown to the endangered person in the body of water 122.

Figure 27:
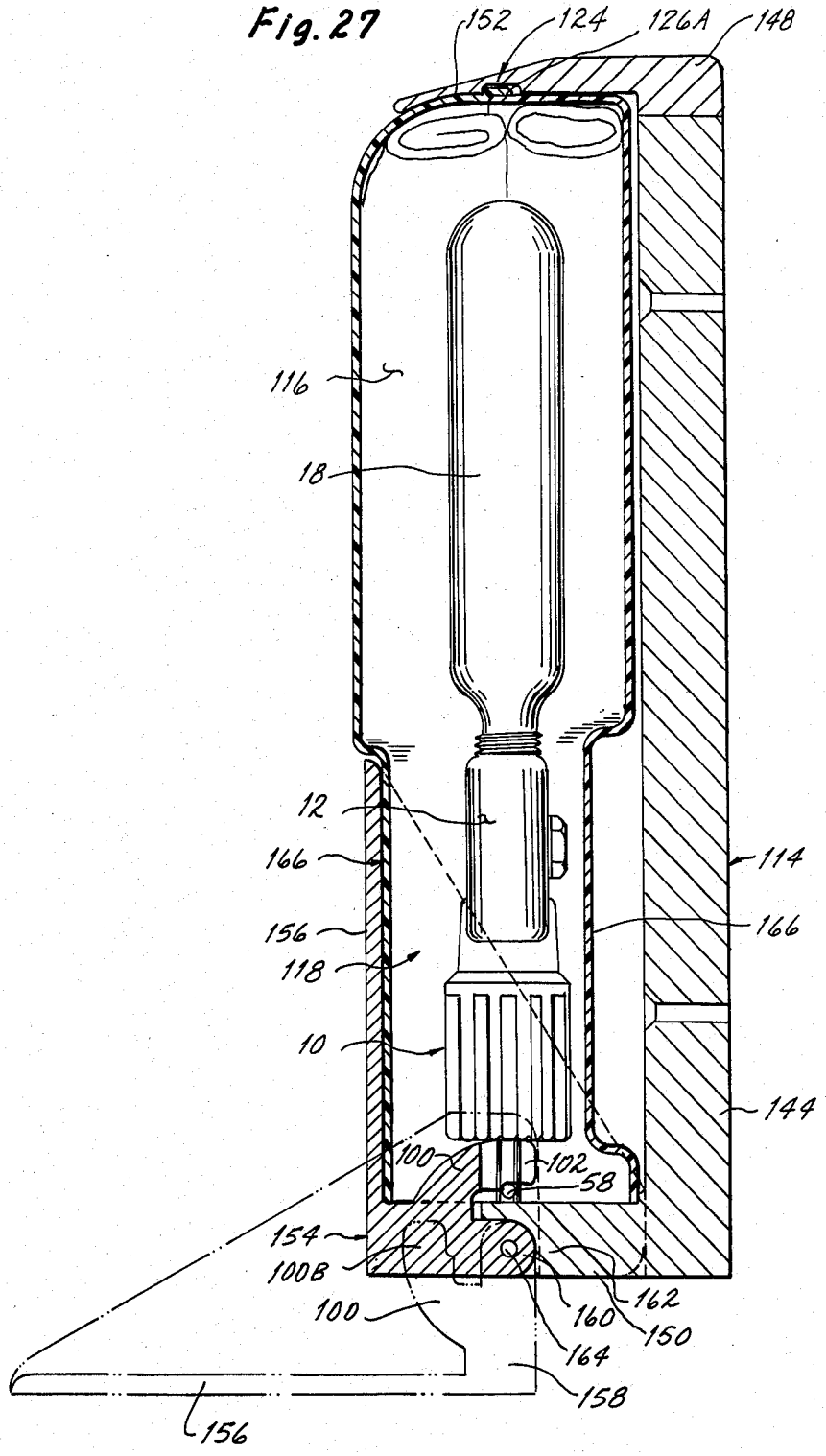
FIG. 27 is a longitudinal view, partially in section, of the second embodiment of the throwable automatic personal flotation device of the invention in which the removable safety latch lever is made an integral part of the latching handle of the bracket.

FIG. 27 illustrates another embodiment of the latch lever 100 in which it is formed integrally with the latching handle 154. In this embodiment, the latch lever 100 is disengaged from the proximal end 52 of the actuator pin 36 upon movement of the latching handle 154 to its open position, as shown in phantom. This embodiment is preferable over the other since the canister 112 is fully armed simply by opening the latching handle 154 thereby reducing the amount of force required to remove the canister 112 from the bracket 114.

It should be appreciated that the integration of the safety latched automatic actuator 10 into the throwable automatic personal flotation device 110 of this invention allows the device 110 to be stored in a marine environment without premature or inadvertent inflation of the personal flotation device 116. Specifically, with the bracket 114 mounted in a position exposed to the environment including precipitation, it becomes readily apparent that all precipitation is precluded from flowing into the canister 112 because of the sealed seam 124 and, further, because of the fact that the opened end 168 of the canister 112 extends downwardly. Additionally, it is readily apparent that humid atmospheric conditions will not adversely affect the automatic actuator 18 because of the safety latched feature of the same.

The present disclosure includes that contained in the apended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A safety latched automatic actuator for actuating an inflator, the inflator including a striker pin reciprocatingly mounted within a body for fracturing a frangible seal of a cartridge containing compressed gas, the actuator comprising in combination:

a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever comprising a non-removable forked safety latch lever having a pair of legs defining a slotted opening therebetween for receiving the proximal end of the actuator pin, each of the legs including a retaining pin slot disposed therein for slidably and rotatably receiving the respective end of the retaining pin, the retaining pin being aligned and extending into the respective retaining pin slots such that the retaining pin bears against the edges of the retaining pin slots to retain the actuator pin in the safety position when the forked latch lever is in the non-armed position and, upon pivotable movement of the forked latch lever about the axis of the retaining pin, such that the longitudinal axes of the retaining pin slots are substantially parallel to the axis of the actuator pin when the forked latch lever is in the armed position to allow free movement of the retaining pin in the retaining pin slots.

2. The safety latched automatic actuator as set forth in claim 1, further comprising handle means connected to the latch lever to facilitate movement of the latch lever to and from the non-armed position and the armed position.

3. The safety latched automatic actuator as set forth in claim 2, wherein the handle means extends transversely to the axis of the actuator pin when the lever is in the non-armed position.

4. The safety latched automatic actuator as set forth in claim 2, wherein the handle means extends flush with the outside surface of the housing when the latch lever is in the armed position.

5. A safety latched automatic actuator for actuating an inflator, the inflator including a striker pin reciprocatingly mounted within a body for fracturing a frangible seal of a cartridge containing compressed gas, the actuator comprising in combination:

a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever comprising a rotary latch lever including an axial hole positioned therethrough for rotatably receiving the proximal end of the actuator pin and a blind slot positioned therein transverse to the axial hole for receiving the retaining pin when aligned therewith, whereby the retaining pin bears against the upper surface of the rotary latch lever to retain the actuator pin in the safety position when the rotary latch lever is in the non-armed position and whereby the blind slot is aligned with the retaining pin when the rotary latch lever is in the armed position.

6. A safety latched automatic actuator for actuating an inflator, the inflator including a striker pin reciprocatingly mounted within a body for fracturing a frangible seal of a cartridge containing compressed gas, the actuator comprising in combination:

a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever comprising a transverse rotary latch lever having a generally cylindrical configuration and including a transverse slot positioned transversely therethrough to receive the actuator pin and permit the actuator pin to rotate about an axis transverse to the actuator pin and a blind slot positioned longitudinally therein for receiving the retaining pin when aligned therewith, whereby the retaining pin bears against the upper surface of the transverse rotary latch lever to retain the actuator pin in the safety position when the transverse rotary latch lever is in the non-armed position and whereby the blind slot is aligned with the retaining pin when the transverse rotary latch lever is in the armed position.

7. A safety latched automatic actuator for actuating an inflator, the inflator including a striker pin reciprocatingly mounted within a body for fracturing a frangible seal of a cartridge containing compressed gas, the actuator comprising in combination:

a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever comprising a non-removable push-pull latch lever having a generally flat configuration and including a closed actuator pin slot positioned therethrough to slidably and non-removably receive the actuator pin and a blind slot positioned therein transverse to the actuator pin slot for receiving the retaining pin when aligned therewith, such that the retaining pin bears against the upper surface of the push-pull latch lever to retain the actuator pin in the safety position when the push-pull latch lever is in the non-armed position and such that the blind slot is aligned with the retaining pin when the push-pull latch lever is in the armed position allowing the actuator pin to move from the cocked position to the actuated position upon the triggering of the trigger assembly.

8. A safety latched automatic actuator for actuating an inflator, the inflator including a striker pin reciprocatingly mounted within a body for fracturing a frangible seal of a cartridge containing compressed gas, the actuator comprising in combination:

a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever being movable to the armed position by removing the latch lever from the actuator and comprising a portion of a fixed support.

9. A safety latched automatic actuator for actuating an inflator, the inflator including a striker pin reciprocatingly mounted within a body for fracturing a frangible seal of a cartridge containing compressed gas, the actuator comprising in combination:

a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever being movable to the armed position by removing the latch lever from the actuator and comprising a forked latch lever having a pair of legs defining a slotted opening therebetween for receiving the proximal end of the actuator pin, each leg including a rounded end such that the respective ends of the retaining pin rest upon the legs to retain the actuator pin in the safety position when the forked latch lever is in the non-armed position and such that the actuator pin is released by the forked latch lever when the forked latch lever is moved to the armed position by pivotable movement of the forked latch lever about an axis transverse to the axis of the actuator pin and removing the forked latch lever from the actuator.

10. The safety latched automatic actuator as set forth in claim 9, further comprising a throwable personal flotation assembly in which is incorporated the safety latched automatic actuator, the inflator, the cartridge of compressed gas, and a flotation device.

11. The safety latched automatic actuator as set forth in claim 10, wherein the throwable personal flotation assembly comprises a canister composed of two half-sections which are removably fastened together at a seam.

12. The safety latched automatic actuator as set forth in claim 11, wherein the canister includes a handle portion to facilitate the throwing of the canister.

13. The safety latched automatic actuator as set forth in claim 11, wherein the seam comprises a tongue-and-groove configuration.

14. The safety latched automatic actuator as set forth in claim 11, wherein the throwable personal flotation assembly includes a bracket for storing the canister and wherein the latch lever is formed as a component of the bracket.

15. The safety latched automatic actuator as set forth in claim 14, wherein the bracket includes a latching handle and wherein the latch lever is formed integrally with the latching handle.

16. A safety latched automatic actuator for actuating an inflator, the inflator including a striker pin reciprocatingly mounted within a body for fracturing a frangible seal of a cartridge containing compressed gas, the actuator comprising in combination:

a housing including a bottom portion and a top portion;

an actuator pin mounted within the housing, the actuator pin being movable to and from a safety position, a cocked position, and an actuator position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever being movable to the armed position by removing the latch lever from the actuator and comprising a forked latch lever having a pair of legs defining a slotted opening therebetweeen for receiving the proximal end of the actuator pin, whereby the respective ends of the retaining pin rest upon the legs to retain the actuator pin in the safety position when the forked latch lever is in the non-armed position and whereby the actuator pin is released by the forked latch lever when the forked latch lever is moved to the armed position by removing the forked latch lever from the actuator, the latch lever comprising a portion of a fixed support.

17. A throwable personal flotation device, comprising in combination:

a flotation device;

an inflator for inflating the flotation device, the inflator including a striker pin reciprocatingly mounted within a body for fracturing a frangible seal of a cartridge containing compressed gas;

an automatic actuator for automatically actuating the inflator upon exposure to a fluid such as water;

a throwable canister for containing the flotation device, inflator, and the actuator, the canister comprising two sections which are removably fastened together at a seam whereby, upon exposure to the fluid, the actuator actuates the inflator which then begins inflating of the flotation device causing the two sections to separate to fully release the flotation device;

a bracket for storing the canister for subsequent exigent use; and the actuator comprising in combination a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid;

safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever being movable to the armed position by removing the latch lever from the actuator and comprising a forked latch lever having a pair of legs defining a slotted opening therebetween for receiving the proximal end of the actuator pin, each leg including a rounded end such that the respective ends of the retaining pin rest upon the legs to retain the actuator pin in the safety position when the forked latch lever is in the non-armed position and such that the actuator pin is released by the forked latch lever when the forked latch lever is moved to the armed position by pivotable movement of the forked latch lever about an axis transverse to the axis of the actuator pin and removing the forked latch lever from the actuator, the latch lever being integral with the bracket such that, upon removal of the canister from the bracket, the latch lever is moved to the armed position.

18. A throwable personal flotation device, comprising in combination:

a flotation device;

an inflator for inflating the flotation device, the inflator including a striker pin reciprocatingly mounted within a body for fracturing a frangible seal of a cartridge containing compressed gas;

an automatic actuator for automatically actuating the inflator upon exposure to a fluid such as water;

a throwable canister for containing the flotation device, inflator, and the actuator, the canister comprising two sections which are removably fastened together at a seam whereby, upon exposure to the fluid, the actuator actuates the inflator which then begins inflating of the flotation device causing the two sections to separate to fully release the flotation device;

a bracket for storing the canister for subsequent exigent use; the bracket including a latching handle operable to and from a closed position securing the canister in the bracket and an opened position permitting the canister to be removed from the bracket;

the actuator comprising in combination a housing including a bottom portion and a top portion;

an actuator pin mounted within the housing, the actuator pin being movable to and from a safety position, a cocked position, and an actuated position;

a first means for operatively connecting the actuator pin within the housing to actuate the striker pin of the inflator when the actuator pin moves from the cocked position to the actuated position;

a fluid-activated trigger assembly for preventing the actuator pin from moving from the cocked position to the actuated position until triggering of the trigger assembly by exposure to a fluid; and safety latch means for retaining the actuator pin in the safety position when the safety latch means is in a non-armed position, and for permitting the actuator pin to move from the safety position to the cocked position and, upon triggering of the trigger assembly, to further move to the actuated position when the safety latch means is moved from the non-armed position to an armed position, the safety latch means comprising a latch lever movable to and from the non-armed position and the armed position, and further comprising second means for operatively connecting the latch lever to the actuator pin to retain the actuator pin in the safety position when the latch lever is in the non-armed position and to permit the actuator pin to move from the safety position to the cocked position and, upon triggering of the trigger assembly, to further move to the actuated position when the latch lever is in the armed position, the second connecting means comprising a retaining pin positioned transversely through a proximal end of the actuator pin protruding from the top portion of the housing, the latch lever being movable to the armed position by removing the latch lever from the actuator and comprising a forked latch lever having a pair of legs defining a slotted opening therebetween for receiving the proximal end of the actuator pin, each leg including a rounded end such that the respective ends of the retaining pin rest upon the legs to retain the actuator pin in the safety position when the forked latch lever is in the non-armed position and such that the actuator pin is released by the forked latch lever when the forked latch lever is moved to the armed position by pivotable movement of the forked latch lever about an axis transverse to the axis of the actuator pin and removing the forked latch lever from the actuator, the latch lever being integral with the latching handle such that, upon moving the latching handle from the closed position to the opened position, the latch lever is moved to the armed position.

* * * * *